US007681422B2

(12) United States Patent
Tonaltzin

(10) Patent No.: US 7,681,422 B2
(45) Date of Patent: Mar. 23, 2010

(54) GIFT BOX APPARATUS AND METHOD THEREFOR

(76) Inventor: Jennifer A. Tonaltzin, 3220 Carbondale St., Las Vegas, NV (US) 89136

( * ) Notice: Subject to any disclaimer, the term of this patent is extended or adjusted under 35 U.S.C. 154(b) by 286 days.

(21) Appl. No.: 11/972,767

(22) Filed: Jan. 11, 2008

(65) Prior Publication Data

US 2009/0134209 A1 May 28, 2009

Related U.S. Application Data

(63) Continuation-in-part of application No. 11/945,127, filed on Nov. 26, 2007, now abandoned.

(51) Int. Cl.
*E05B 65/52* (2006.01)

(52) U.S. Cl. ..... 70/63; 70/161; 70/162; 70/267; 70/456 R; 109/47; 109/53; 206/37.4; 340/309.16

(58) Field of Classification Search ..... 70/57, 70/63, DIG. 45, DIG. 50, 266–274, 279.1, 70/158–162, 456 R, 459; 24/3.6; 109/47, 109/49, 53–57; 206/37.1, 37.2, 37.4, 38.1, 206/459.1, 534; 220/4.22, 503, 505, 735; 340/309.16

See application file for complete search history.

(56) References Cited

U.S. PATENT DOCUMENTS

| | | | | | |
|---|---|---|---|---|---|
| 513,061 | A * | 1/1894 | Slater | 312/204 |
| 1,481,194 | A * | 1/1924 | Fischer | 220/503 |
| 2,062,417 | A * | 12/1936 | Jay | 109/47 |
| 2,672,043 | A * | 3/1954 | Folscheid | 70/447 |
| 3,851,506 | A * | 12/1974 | Simon | 70/271 |
| 3,970,010 | A * | 7/1976 | Cantley | 109/56 |
| 4,084,415 | A * | 4/1978 | Corman | 70/269 |
| 4,651,544 | A * | 3/1987 | Hungerford | 70/63 |
| 4,860,563 | A * | 8/1989 | Gerch | 70/456 R |
| D306,697 | S * | 3/1990 | Fonas | D9/432 |
| 5,016,453 | A * | 5/1991 | Bonnice et al. | 70/93 |
| 5,129,536 | A * | 7/1992 | Robinson | 220/211 |
| 5,373,282 | A * | 12/1994 | Carter | 340/5.3 |
| 5,774,059 | A * | 6/1998 | Henry et al. | 340/5.54 |
| 5,794,466 | A * | 8/1998 | Hungerford et al. | 70/63 |
| 5,954,225 | A * | 9/1999 | Powe | 221/2 |
| 6,825,753 | B2 * | 11/2004 | Cardinale et al. | 340/5.73 |
| 7,132,925 | B2 * | 11/2006 | Johnson et al. | 340/5.73 |
| 7,159,710 | B2 * | 1/2007 | O'Brien et al. | 206/1.5 |
| 7,426,841 | B2 * | 9/2008 | Yang | 70/63 |
| 2003/0164014 | A1 * | 9/2003 | Matsushita et al. | 70/456 R |
| 2005/0146419 | A1 * | 7/2005 | Porter | 340/5.73 |
| 2005/0229655 | A1 * | 10/2005 | Yu | 70/63 |

* cited by examiner

*Primary Examiner*—Lloyd A Gall
(74) *Attorney, Agent, or Firm*—Karen J. S. Fouts; Weiss & Moy, P.C.

(57) ABSTRACT

A gift box apparatus having a locking mechanism and a programmable timer for selecting a specific date and time for when the gift box apparatus may become unlocked to reveal a gift contained therein is disclosed. In one embodiment, the gift box apparatus includes an integrated compartment that may be automatically released from the gift box apparatus at a preselected time, thereby revealing a key contained therein, which may be used by a recipient of the gift box apparatus to unlock a main compartment of the gift box apparatus and retrieve a gift contained therein.

14 Claims, 3 Drawing Sheets

GIFT BOX APPARATUS AND METHOD THEREFOR

RELATED APPLICATION

This application is a continuation-in-part of, and claims priority to, U.S. patent application Ser. No. 11/945,127, filed Nov. 26, 2007, now abandoned.

FIELD OF THE INVENTION

This invention relates generally to gift boxes and, more particularly, to a gift box apparatus having a locking mechanism and a programmable timer for selecting a specific date and time for when the gift box apparatus may become unlocked to reveal a gift contained therein, and method therefor.

BACKGROUND OF THE INVENTION

Gift boxes have been used for the presentation of gifts for all kinds of occasions imaginable, such as birthdays, anniversaries, holidays, and the like. Many different kinds of gift boxes have been developed for gift presentation, ranging from simple to complex gift box configurations. For example, it is known to provide a gift box that is lockable. As another example, it is also known to provide a gift box with a timed locking mechanism that may be programmed to automatically unlock at a specific time, to reveal a gift inside the gift box. Limitations exist with such prior art gift boxes. For example, with respect to the prior art gift box with the timed locking mechanism, the gift recipient has no control over when the gift box opens to reveal the gift contained therein. This can be a disadvantage when, for example, the gift recipient happens to be away from the gift box at the time that the gift box automatically opens. This may result in disappointment for the gift recipient, in that it may be more exciting for the gift recipient to be able to observe the gift box open.

A need therefore exists for a gift box apparatus having a locking mechanism and a programmable timer for selecting a specific date and time for when the gift box apparatus may become unlocked to reveal a gift contained therein, that requires a recipient to open the gift box.

The present invention satisfies this need and provides other, related advantages.

SUMMARY OF THE INVENTION

In accordance with an embodiment of the present invention, a gift box apparatus is disclosed. The gift box apparatus comprises, in combination: a container portion with a gift compartment and a key compartment, wherein the key compartment is adapted to be selectively released from the container portion; a lid portion coupled to the container portion; a locking mechanism operated by a key located in the key compartment and adapted to lockably secure the lid portion to the container portion; and a timer adapted to be programmed to permit the key compartment to be released from the container portion at a particular time so that the key may be removed therefrom.

In accordance with another embodiment of the present invention, a gift box apparatus is disclosed. The gift box apparatus comprises, in combination: a container portion with a first compartment and a second compartment, wherein the second compartment is adapted to be selectively released from the container portion; a lid portion coupled to the container portion; a locking mechanism adapted to lockably secure the lid portion to the container portion; a timer adapted to be programmed to permit the second compartment to be released from the container portion at a particular time; and a key located in the second compartment, wherein the key is adapted to unlock the locking mechanism in order to permit access to the first compartment.

In accordance with a further embodiment of the present invention, a method for presenting a gift is disclosed. The method comprises the steps of: providing a gift article; providing a gift box apparatus comprising, in combination: a container portion with a gift compartment and a key compartment, wherein the key compartment is adapted to be selectively released from the container portion; a lid portion coupled to the container portion; a locking mechanism operated by a key located in the key compartment and adapted to lockably secure the lid portion to the container portion; and a timer adapted to be programmed to permit the key compartment to be released from the container portion at a particular time so that the key may be removed therefrom; programming the timer; placing the gift article inside the gift box apparatus; locking the lid portion to the container portion; and presenting the gift box apparatus to a recipient.

DETAILED DESCRIPTION OF THE PREFERRED EMBODIMENTS

Figure 1:
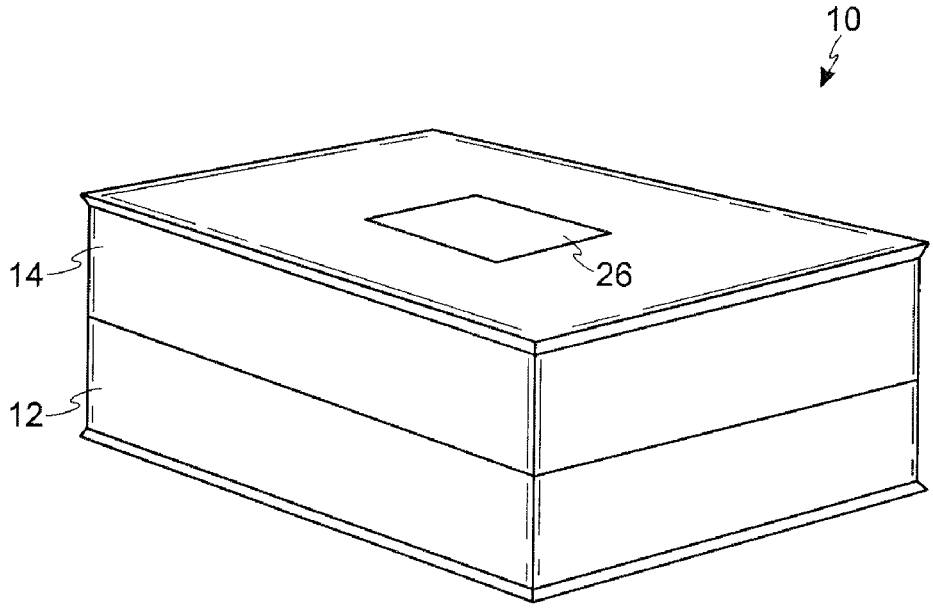
FIG. 1 is a perspective view of an embodiment of the gift box apparatus of the present invention.
Figure 2:
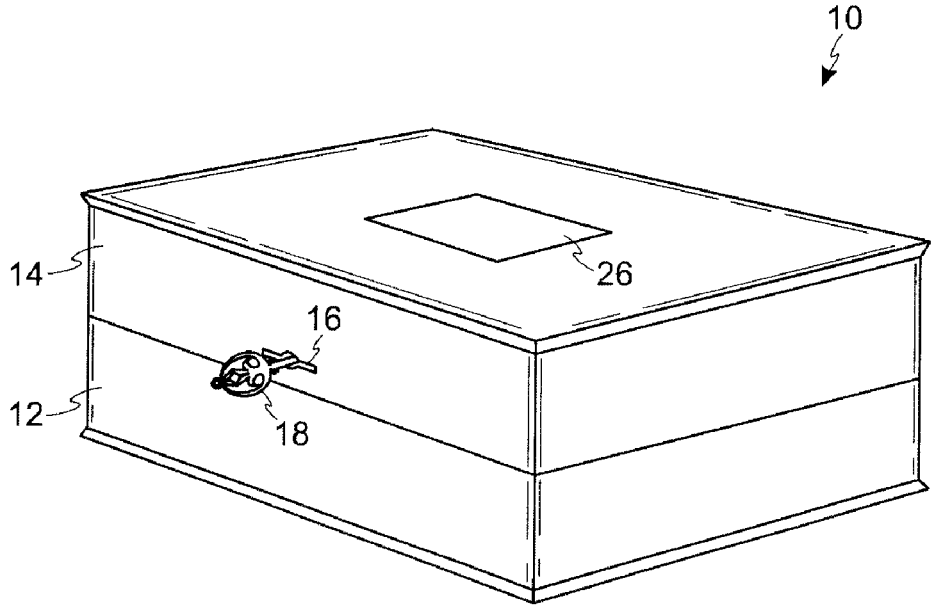
FIG. 2 is a perspective view of another embodiment of the gift box apparatus of the present invention.
Figure 4:
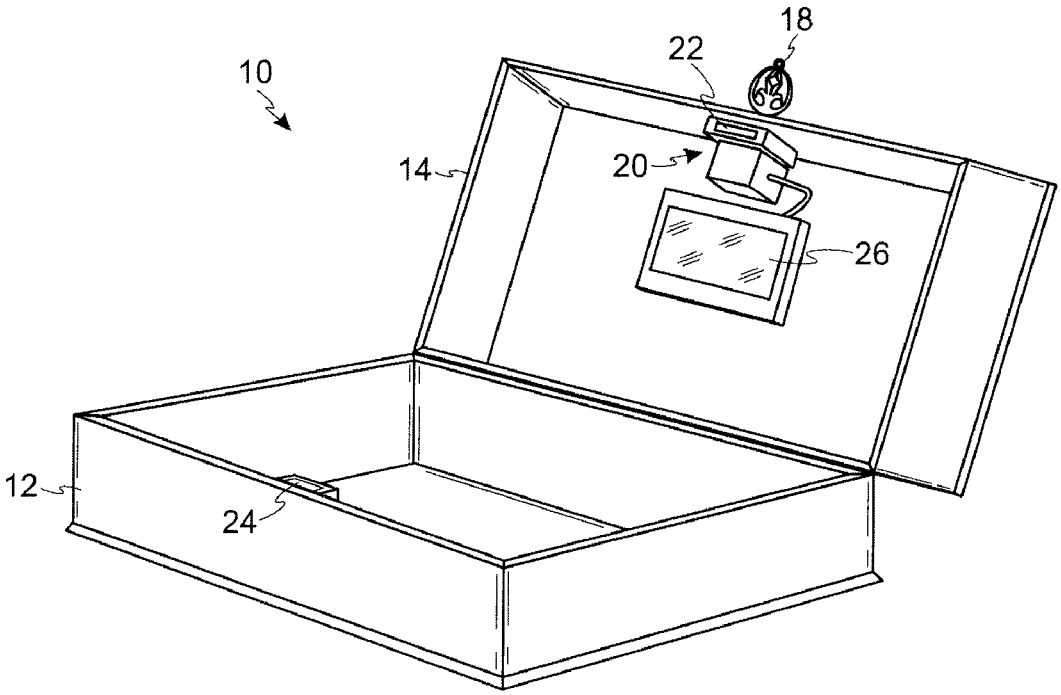
FIG. 4 is a perspective view of the gift box apparatus of FIG. 2, in an opened position.

Referring first to FIGS. 1, 2 and 4, an embodiment of a gift box apparatus 10, consistent with an embodiment of the present invention is shown. The gift box apparatus 10 generally comprises a container portion 12, a lid portion 14, a locking mechanism 20 (as shown in FIG. 4), and a programmable timer 26. The gift box apparatus 10 may further comprise a key hole 16 and a key 18 (as shown in FIG. 2).

In this embodiment, the lid portion 14 is coupled to the container portion 12 such that the container portion 12 and the lid portion 14 form a one-piece assembly. It may be desired to fashion a gift box apparatus 10 wherein the container portion 12 and lid portion 14 comprise separate components, which could be connected to each other by way of hinges or some other suitable coupling mechanism.

In a preferred embodiment, the gift box apparatus 10 is substantially rectangular. Two sizes in particular are preferred for the gift box apparatus 10, with a first preferred size measuring approximately 10¾ inches long by 5¾ inches wide, with a height of 2⅓ inches, and a second preferred size measuring approximately 7 inches long by 3½ inches wide, with a height of 1½ inches. However, it should be clearly understood that the gift box apparatus 10 may consist of various other dimensions, as desired. The gift box apparatus 10 may also take on virtually any shape imaginable, such as that of a heart, square, oval, circle, triangle, and the like.

Turning to FIG. 4, the locking mechanism 20 is dimensioned to lock the lid portion 14 in a closed position over the container portion 12 of the gift box apparatus 10. The locking mechanism 20 includes a locking tab 22, dimensioned to be inserted into a receiving slot 24. The key 18 is dimensioned to be inserted into the key hole 16 (as shown in FIG. 2). Insertion of the key 18 into the key hole 16 allows for manual operation of the locking mechanism 20, to enable a user to open the gift box apparatus 10 at any time, if desired. Turning the key 18 in a first direction directs the locking tab 22 into the receiving slot 24, thereby locking the gift box apparatus 10. Turning the key 18 in a second direction directs the locking tab 22 out of the receiving slot 24, thereby unlocking the gift box apparatus 10. As shown in the embodiment in FIG. 2, the key hole 16 is positioned on a front area of the lid portion 14, corresponding to a location of the locking mechanism 20 in an internal portion of the gift box apparatus 10. It should be clearly understood that the key hole 16 and locking mechanism 20 could be positioned elsewhere on the gift box apparatus 10, so long as the locking mechanism 20 is capable of locking the lid portion 14 in a closed position over the container portion 12. In the preferred embodiment, the locking mechanism 20 automatically switches from a locked position (in which the locking tab 22 is situated in the receiving slot 24) to an unlocked position (in which the locking tab 22 is released from the receiving slot 24) at a time when the timer 26 reaches zero during a countdown, as further discussed below. The switching of the locking mechanism 20 from a locked position to an unlocked position allows a recipient of the gift box apparatus 10 to lift the lid portion 14 from the container portion 12, thereby gaining access to a gift article (not shown) that may be contained therein.

Figure 5:
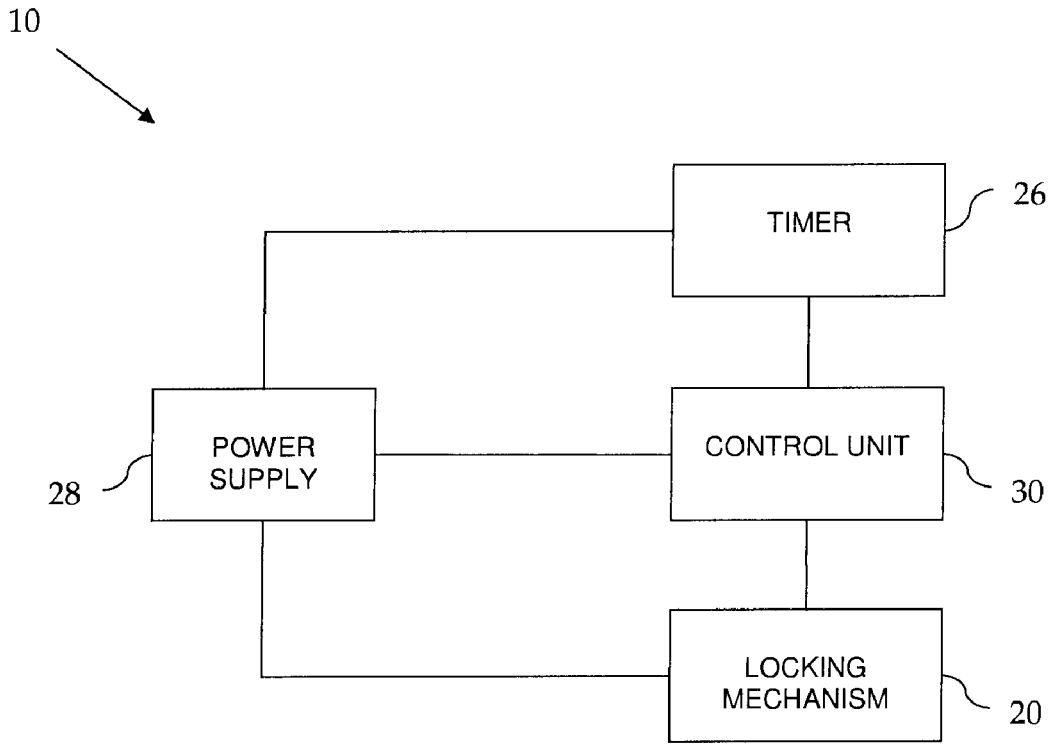
FIG. 5 is a simplified block diagram of the gift box apparatus of FIGS. 1 and 2.

The locking mechanism 20 is preferably electronically controlled and connected to the timer 26 through conventional electrical circuitry. Turning to FIG. 5, the gift box apparatus 10 preferably includes a main control unit 30. The control unit 30 will send a signal to the locking mechanism 20 to switch from a locked position to an unlocked position at a time when the control unit 30 monitors that the timer 26 has counted down to zero. The gift box apparatus 10 may further include a power supply 28, such as a conventional battery or some other suitable electronic power supply, for supplying power to the control unit 30, timer 26 and locking mechanism 20.

In the preferred embodiment, the timer 26 is incorporated in the lid portion 14 of the gift box apparatus 10. However, the timer 26 may be positioned in other areas of the gift box apparatus 10, as desired. In this embodiment, the timer 26 is embedded in the lid portion 14, such that it is flush with an outer surface of the lid portion 14. It should be understood, however, that the timer 26 may be positioned such that it is raised or lowered relative to an outer surface of the lid portion 14. The timer 26 is preferably digital and may be comprised of a liquid crystal display or the like. Preferably, the timer 26 includes a control panel that may be accessed from inside the gift box apparatus 10 when the gift box apparatus 10 is in an open position, as shown in FIG. 4. By way of the control panel, a user of the gift box apparatus 10 may set the timer 26 to count down to a specific time, such as the recipient's birthday, wedding day, anniversary, graduation day, retirement, a holiday, a baby's due date, or some other special occasion or even a non-gift-giving occasion. In the preferred embodiment, when the timer 26 reaches "zero," the locking mechanism 20 is triggered to switch from a locked position to an unlocked position, thereby allowing a recipient of the gift box apparatus 10 to lift the lid portion 14 from the container portion 12, thereby gaining access to a gift article (not shown) that may be contained therein. Using the gift box apparatus 10 without the key 18 would allow a user to present a gift to a recipient prior to the special occasion in question, without the user having to worry about the recipient opening the present prematurely or attempting to get a "sneak peek" at the gift.

The gift box apparatus 10 is preferably composed of wood, metal, plastic, cardboard, fiberboard, recycled materials, or the like. The gift box apparatus 10 could be produced in a plethora of eye-catching colors and could display various designs appropriate for an array of special occasions or holidays.

Figure 3:
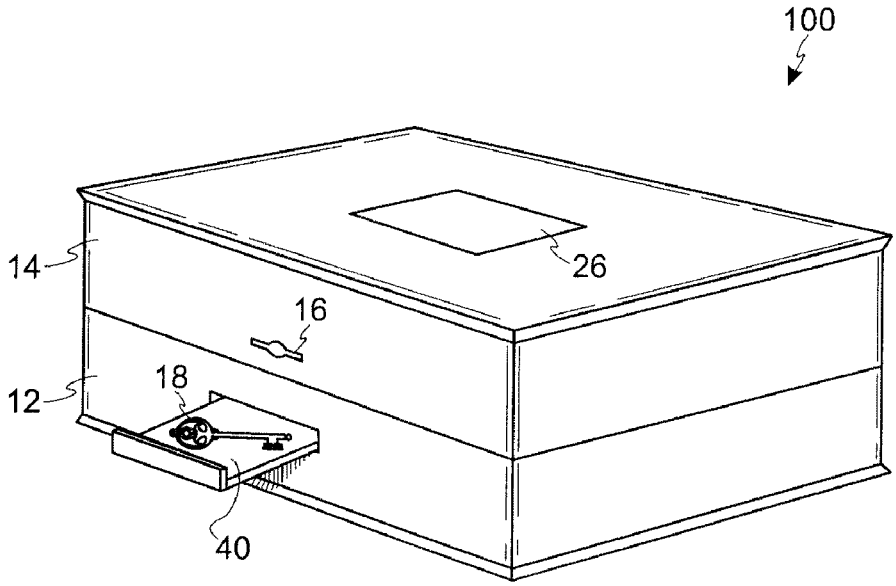
FIG. 3 is a perspective view of another embodiment of the gift box apparatus of the present invention.

Referring now to FIG. 3, another embodiment of the gift box apparatus 10, hereinafter 100, is shown. The gift box apparatus 100 is essentially the same as the gift box apparatus 10, but includes the additional feature of an integrated compartment 40. In the preferred embodiment, the integrated compartment 40 is positioned in the container portion 12 of the gift box apparatus 100. However, the integrated compartment 40 may be positioned elsewhere on the gift box apparatus 100, as desired. The integrated compartment 40 is preferably adapted to retain the key 18, which may be used to manually switch the locking mechanism 20 from a locked position to an unlocked position, as discussed above. Preferably, the integrated compartment 40 automatically slides forward from the container portion 12 (or from some other area of the gift box apparatus 100 in which the integrated compartment 40 may be positioned) at a time when the timer 26 reaches zero. The sliding forward of the integrated compartment 40 reveals the key 18, making the key 18 available to a recipient of the gift box apparatus 100. The recipient may then use the key 18 to manually unlock the locking mechanism 20 and retrieve a gift contained in the gift box apparatus 100.

Figure 6:
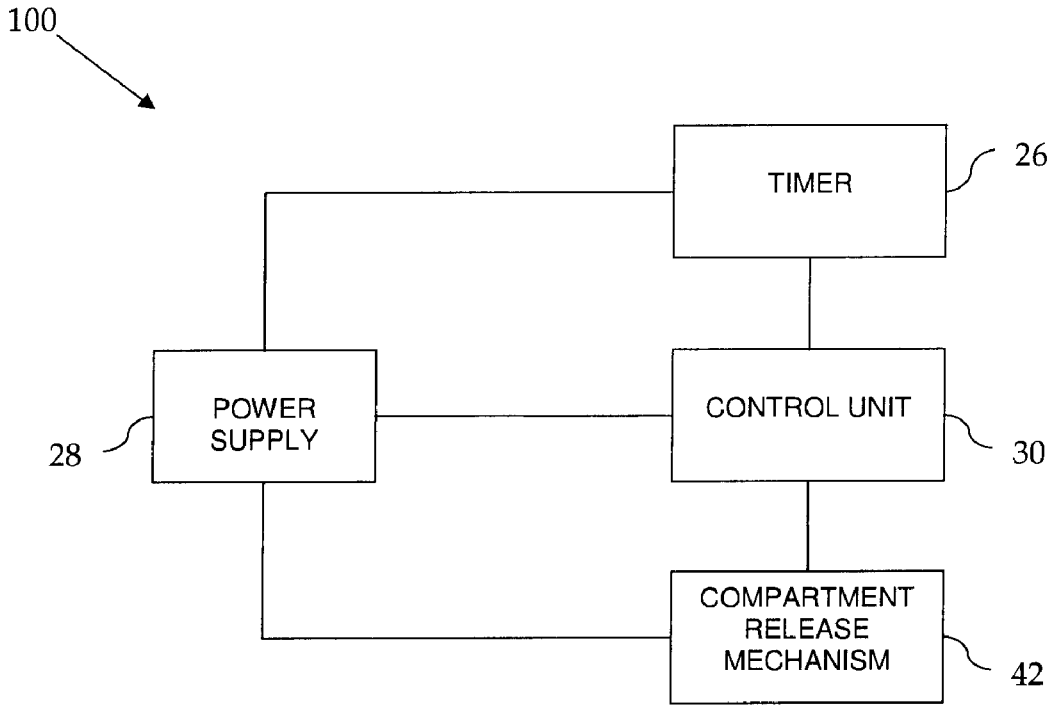
FIG. 6 is a simplified block diagram of the gift box apparatus of FIG. 3.

As with the gift box apparatus 10, the locking mechanism 20 on the gift box apparatus 100 is preferably electronically controlled and connected to the timer 26 through conventional electrical circuitry. Turning to FIG. 6, the gift box apparatus 100 preferably includes a main control unit 30. The control unit 30 will send a signal to a compartment release mechanism 42 to release the integrated compartment 40 at a time when the control unit 30 monitors that the timer 26 has counted down to zero. The gift box apparatus 100 may further include a power supply 28, such as a conventional battery or some other suitable electronic power supply, for supplying power to the control unit 30, timer 26 and compartment release mechanism 42.

While the invention has been particularly shown and described with reference to preferred embodiments thereof, it will be understood by those skilled in the art that the foregoing and other changes in form and details may be made therein without departing from the spirit and scope of the invention. For example, it may be desired to incorporate a music chip in the gift in the gift box apparatus 10 or 100, through which various songs could play as the gift box apparatus 10 or 100 is opened.

I claim:

1. A gift box apparatus comprising, in combination:

a container portion with a gift compartment and a key compartment, wherein the key compartment is adapted to be selectively released from the container portion;

a lid portion coupled to the container portion;

a locking mechanism operated by a key located in the key compartment and adapted to lockably secure the lid portion to the container portion; and a timer adapted to be programmed to permit the key compartment to be released from the container portion at a particular time so that the key may be removed therefrom.

2. The gift box apparatus of claim 1, further comprising a gift article located in the gift compartment.

3. The gift box apparatus of claim 1 further comprising a main control unit adapted to transmit a signal to a compartment release mechanism to release the key compartment from the container portion at a time when the control unit monitors that the timer has counted down to zero.

4. The gift box apparatus of claim 1, wherein the container portion and lid portion are composed of one of wood, metal, plastic, cardboard, fiberboard and recycled materials.

5. A gift box apparatus comprising, in combination:

a container portion with a first compartment and a second compartment, wherein the second compartment is adapted to be selectively released from the container portion;

a lid portion coupled to the container portion;

a locking mechanism adapted to lockably secure the lid portion to the container portion;

a timer adapted to be programmed to permit the second compartment to be released from the container portion at a particular time; and a key located in the second compartment, wherein the key is adapted to unlock the locking mechanism in order to permit access to the first compartment.

6. The gift box apparatus of claim 5, further comprising a gift article located in the first compartment.

7. The gift box apparatus of claim 5, further comprising a gift article located in the second compartment.

8. The gift box apparatus of claim 5 further comprising a main control unit adapted to transmit a signal to a compartment release mechanism to release the second compartment from the container portion at a time when the control unit monitors that the timer has counted down to zero.

9. The gift box apparatus of claim 5, wherein the container and lid are composed of one of wood, metal, plastic, cardboard, fiberboard and recycled materials.

10. A method for presenting a gift, comprising the steps of:

providing a gift article;

providing a gift box apparatus comprising, in combination:

a container portion with a gift compartment and a key compartment, wherein the key compartment is adapted to be selectively released from the container portion;

a lid portion coupled to the container portion;

a locking mechanism operated by a key located in the key compartment and adapted to lockably secure the lid portion to the container portion; and a timer adapted to be programmed to permit the key compartment to be released from the container portion at a particular time so that the key may be removed therefrom;

programming the timer;

placing the gift article inside the gift box apparatus;

locking the lid portion to the container portion; and presenting the gift box apparatus to a recipient.

11. The method of claim 10, wherein the gift article is placed in the gift compartment.

12. The method of claim 10, wherein the gift box apparatus further comprises a main control unit adapted to transmit a signal to a compartment release mechanism to release the key compartment from the container portion at a time when the control unit monitors that the timer has counted down to zero.

13. The method of claim 10, wherein the particular time is one of a birthday, holiday, wedding day, anniversary, graduation day, retirement and baby's due date.

14. The method of claim 10, wherein the container and lid are composed of one of wood, metal, plastic, cardboard, fiberboard and recycled materials.

* * * * *